US009352526B2

(12) United States Patent
Pettersson

(10) Patent No.: US 9,352,526 B2
(45) Date of Patent: May 31, 2016

(54) ELEVATED CONVERTING MACHINE WITH OUTFEED GUIDE

(71) Applicant: PACKSIZE LLC, Salt Lake City, UT (US)

(72) Inventor: Niklas Pettersson, Vasteras (SE)

(73) Assignee: Packsize LLC, Salt Lake City, UT (US)

( * ) Notice: Subject to any disclaimer, the term of this patent is extended or adjusted under 35 U.S.C. 154(b) by 0 days.

(21) Appl. No.: 14/357,183

(22) PCT Filed: Nov. 9, 2012

(86) PCT No.: PCT/US2012/064414
§ 371 (c)(1),
(2) Date: May 8, 2014

(87) PCT Pub. No.: WO2013/071080
PCT Pub. Date: May 16, 2013

(65) Prior Publication Data

US 2014/0315701 A1 Oct. 23, 2014

Related U.S. Application Data

(60) Provisional application No. 61/558,298, filed on Nov. 10, 2011, provisional application No. 61/640,686, filed on Apr. 30, 2012, provisional application No. 61/643,267, filed on May 5, 2012.

(51) Int. Cl.
*B31B 1/20* (2006.01)
*B26D 1/18* (2006.01)
(Continued)

(52) U.S. Cl.
CPC ... *B31B 1/20* (2013.01); *B26D 1/18* (2013.01); *B26D 1/185* (2013.01); *B26D 7/2635* (2013.01);
(Continued)

(58) Field of Classification Search
CPC ..... B31B 19/26; B31B 1/36; B31B 21/00; B31B 2217/0038; B31B 2219/2672; B31B 3/00; B31B 7/00
USPC ..... 493/56
See application file for complete search history.

(56) References Cited

U.S. PATENT DOCUMENTS 2,256,082 A 9/1941 Feurt
2,798,582 A 7/1957 Monroe
(Continued)

FOREIGN PATENT DOCUMENTS

CN 2164350 5/1994
CN 1366487 8/2002
(Continued)

OTHER PUBLICATIONS

International Search Report and Written Opinion, PCT/US2012/064414, US Search Authority, Completed Jan. 4, 2013, Mailed Jan. 25, 2013.
(Continued)

*Primary Examiner* — Robert Long
(74) *Attorney, Agent, or Firm* — Workman Nydegger

(57) ABSTRACT

A system that converts fanfold material into packaging templates includes a converting assembly that performs conversion functions, such as cutting, creasing, and scoring, on the fanfold material as the fanfold material moves through the converting machine in a first direction. The converting assembly may be mounted on a frame such that the converting assembly is elevated above a support surface. An outfeed guide may change the direction of movement of the fanfold material from the first direction to a second, generally vertical direction after the converting assembly has performed the conversion functions on the fanfold material.

32 Claims, 7 Drawing Sheets

(51) Int. Cl.

| | |
|---|---|
| ***B26D 7/26*** | (2006.01) |
| ***B26D 9/00*** | (2006.01) |
| ***B31B 1/00*** | (2006.01) |
| *B26D 3/08* | (2006.01) |
| *B26D 5/00* | (2006.01) |
| *B26F 1/00* | (2006.01) |
| *B26D 7/00* | (2006.01) |

(52) U.S. Cl.

CPC ... *B26D 9/00* (2013.01); *B31B 1/00* (2013.01); *B26D 3/08* (2013.01); *B26D 5/00* (2013.01); *B26D 2007/0093* (2013.01); *B26F 1/00* (2013.01); *B31B 2201/14* (2013.01); *B31B 2201/143* (2013.01); *B31B 2201/147* (2013.01); *B31B 2201/257* (2013.01); *B65B 2210/04* (2013.01)

(56) References Cited

U.S. PATENT DOCUMENTS

| | | | | |
|---|---|---|---|---|
| 3,303,759 | A | 2/1967 | Burke | |
| 3,743,154 | A * | 7/1973 | Brewitz | 226/113 |
| 4,052,048 | A | 10/1977 | Shirasaka | |
| 4,173,106 | A * | 11/1979 | Leasure | B65B 1/02 53/170 |
| 4,375,970 | A | 3/1983 | Murphy | |
| 4,487,596 | A * | 12/1984 | Livens | B31B 1/44 493/125 |
| 4,695,006 | A | 9/1987 | Pool | |
| 4,923,188 | A | 5/1990 | Neir | |
| 5,369,939 | A * | 12/1994 | Moen | B65B 7/285 53/306 |
| 5,375,390 | A * | 12/1994 | Frigo | B65B 5/022 53/373.7 |
| 5,584,633 | A | 12/1996 | Scharer | |
| 5,902,223 | A | 5/1999 | Simmons | |
| 6,189,933 | B1 * | 2/2001 | Felderman | 283/34 |
| 6,397,557 | B1 | 6/2002 | Bassissi et al. | |
| 6,471,154 | B1 | 10/2002 | Toth | |
| 6,840,898 | B2 | 1/2005 | Pettersson | |
| 7,100,811 | B2 | 9/2006 | Pettersson et al. | |
| 7,648,451 | B2 * | 1/2010 | Calugi | B31B 1/00 493/111 |
| D703,246 | S | 4/2014 | Pettersson et al. | |
| 2002/0091050 | A1 | 7/2002 | Bacciottini | |
| 2004/0060264 | A1 * | 4/2004 | Miller | B65B 11/18 53/461 |
| 2004/0092374 | A1 * | 5/2004 | Cheng | 493/160 |
| 2005/0103923 | A1 | 5/2005 | Pettersson et al. | |
| 2005/0215409 | A1 * | 9/2005 | Abramson et al. | 493/476 |
| 2007/0079575 | A1 * | 4/2007 | Monti | B29C 47/903 53/458 |
| 2007/0289253 | A1 * | 12/2007 | Miller | 53/218 |
| 2008/0115641 | A1 * | 5/2008 | Freyburger et al. | 83/425.2 |
| 2009/0199527 | A1 * | 8/2009 | Wehr et al. | 55/521 |
| 2010/0041534 | A1 | 2/2010 | Harding et al. | |
| 2011/0026999 | A1 | 2/2011 | Kohira | |
| 2011/0171002 | A1 * | 7/2011 | Pettersson | B65G 57/03 414/794.4 |
| 2011/0230325 | A1 * | 9/2011 | Harding et al. | 493/464 |
| 2011/0319242 | A1 | 12/2011 | Pettersson | |
| 2012/0129670 | A1 * | 5/2012 | Pettersson | B31B 1/62 419/130 |
| 2014/0336026 | A1 | 11/2014 | Pettersson | |
| 2015/0018189 | A1 | 1/2015 | Pettersson et al. | |
| 2016/0001441 | A1 * | 1/2016 | Osterhout | B25H 1/02 108/5 |

FOREIGN PATENT DOCUMENTS

| | | |
|---|---|---|
| EP | 0650827 | 5/1995 |
| EP | 0889779 | 1/1999 |
| EP | 0903219 | 3/1999 |
| EP | 1497049 | 3/2010 |
| FR | 2808722 | 11/2001 |
| WO | WO 03089163 A2 * | 10/2003 |
| WO | 2010091043 | 8/2010 |
| WO | 2011135433 | 11/2011 |
| WO | 2013071073 | 5/2013 |
| WO | 2013071080 | 5/2013 |
| WO | 2013106180 | 7/2013 |

OTHER PUBLICATIONS

International Search Report and Written Opinion, PCT/US2012/064403, US Search Authority, Completed Mar. 26, 2013, Mailed Apr. 8, 2013.

International Search Report and Written Opinion for PCT/US2012/064403 dated Apr. 8, 2013.

International Search Report and Written Opinion for PCT/US2012/070719 dated Feb. 25, 2013.

U.S. Appl. No. 29/419,922, Aug. 6, 2013, Office Action.

U.S. Appl. No. 29/419,922, Nov. 29, 2013, Notice of Allowance.

European Search Report for EP12848321 dated Jul. 1, 2015.

European Search Report for EP12865028 dated Jul. 7, 2015.

* cited by examiner

ELEVATED CONVERTING MACHINE WITH OUTFEED GUIDE

CROSS-REFERENCE TO RELATED APPLICATIONS

This application claims priority to and the benefit of PCT Application No. PCT/US2012/064414, filed Nov. 9, 2012, entitled "ELEVATED CONVERTING MACHINE WITH OUTFEED GUIDE", which claims the benefit of and priority to the following applications: U.S. Provisional Application No. 61/558,298, filed Nov. 10, 2011, entitled "ELEVATED CONVERTING MACHINE WITH OUTFEED GUIDE", U.S. Provisional Application No. 61/640,686, filed Apr. 30, 2012, entitled "CONVERTING MACHINE", and U.S. Provisional Application No. 61/643,267, filed May 5, 2012, entitled "CONVERTING MACHINE", each of which are incorporated herein in their entirety.

BACKGROUND OF THE INVENTION

1. The Field of the Invention

Exemplary embodiments of the invention relate to systems, methods, and devices for converting sheet materials. More specifically, exemplary embodiments relate to an elevated, compact machine for converting paperboard, corrugated board, cardboard, and similar fanfold materials into templates for boxes and other packaging.

2. The Relevant Technology

Shipping and packaging industries frequently use paperboard and other fanfold material processing equipment that converts fanfold materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 40% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 40% larger than the packaged items is much less cost efficient to operate than a shipping vehicle filled with boxes that are custom sized to fit the packaged items. In other words, a shipping vehicle filled with custom sized packages can carry a significantly larger number of oversized packages, which can reduce the number of shipping vehicles required to ship that same number of items. Accordingly, in addition or as an alternative to calculating shipping prices based on the weight of a package, shipping prices are often affected by the size of the shipped package. Thus, reducing the size of an item's package can reduce the price of shipping the item.

Although sheet material processing machines and related equipment can potentially alleviate the inconveniences associated with stocking standard sized shipping supplies and reduce the amount of space required for storing such shipping supplies, previously available machines and associated equipment have had a significant footprint and have occupied a lot of floor space. The floor space occupied by these large machines and equipment could be better used, for example, for storage of goods to be shipped. In addition to the large footprint, the size of the previously available machines and related equipment makes maintenance, repair, and replacement thereof time consuming and expensive. For example, some of the existing machines and related equipment have a length of about 22 feet and a height of 12 feet.

Accordingly, it would be advantageous to have a converting machine with a relatively small footprint, which can save floor space as well as reduce maintenance costs and downtime associated with repair and/or replacement of the machine.

BRIEF SUMMARY OF THE INVENTION

This disclosure relates to systems, methods, and devices for processing paperboard (such as corrugated cardboard) and similar fanfold materials and converting the same into packaging templates. In one embodiment, for instance, a converting machine used to convert generally rigid fanfold material into packaging templates for assembly into boxes or other packaging includes an infeed guide, one or more feed rollers, a converting assembly, and an outfeed guide. The infeed guide directs the fanfold material into the converting machine. The one or more feed rollers move the fanfold material through the converting machine in a first direction. The converting assembly is able to perform one or more conversion functions on the fanfold material as the fanfold material moves through the converting machine. For instance, in order to create the packaging template, the converting assembly may perform one or more of the following conversion functions on the fanfold material: creasing, bending, folding, perforating, cutting, and scoring. After the converting assembly has performed the one or more conversion functions on the fanfold material, the outfeed guide changes the direction of movement of the fanfold material from the first direction to a second, generally vertical direction.

In another embodiment, a method for creating packaging templates for assembly into boxes or other packaging from generally rigid fanfold material may include moving the fanfold material in a first direction. One or more conversion functions may also be performed on the fanfold material as the fanfold material moves in the first direction. The conversion functions may include such functions as creasing, bending, folding, perforating, cutting, and scoring the fanfold material. The method may also include changing the direction of movement of the fanfold material from the first direction to a second, generally vertical direction after performing the one or more conversion functions on the fanfold material.

In yet another embodiment, a converting machine used to convert fanfold material into packaging templates for assembly into boxes or other packaging, may include a frame and a converting assembly cartridge selectively mounted on the frame. The converting assembly cartridge may include at least one longitudinal converting tool that performs one or more conversion functions on the fanfold material in a first, longitudinal direction and at least one transverse converting tool that performs one or more conversion functions on the fanfold material in a second, transverse direction that is generally perpendicular to the first, longitudinal direction. The converting assembly cartridge may also include one or more feed rollers that move the fanfold material through the converting machine in the first, longitudinal direction. The converting assembly cartridge, including the longitudinal and transverse converting tools and the one or more feed rollers, may also be selectively removable as a single unit from the frame. The converting machine may also include an infeed guide mounted on the frame that directs the fanfold material into the converting assembly cartridge.

In other embodiments, a system for forming packaging templates for assembly into boxes or other packaging may include a stack of fanfold material and a converting machine used to convert the fanfold material into the packaging templates. The converting machine may be positioned adjacent to the stack of fanfold material. The converting machine may include a frame that rests upon a support surface and a converting assembly mounted on the frame. The converting assembly may be positioned at a height above the support surface that is generally equal to or greater than a height of a user. The converting assembly may also be positioned at a height above the support surface that is generally equal to or greater than the longest length of the packaging templates so that the packaging templates may hang from the converting assembly without hitting the support surface. The converting assembly may include one or more feed rollers that move the fanfold material through the converting assembly in a first direction and one or more converting tools configured to perform one or more conversion functions on the fanfold material as the fanfold material moves through the converting assembly. The conversion functions may include creasing, bending, folding, perforating, cutting, and scoring the fanfold material. The system may further include an outfeed guide that changes the direction of movement of the fanfold material from the first direction to a second, generally vertical direction after the converting assembly has performed the one or more conversion functions on the fanfold material. Furthermore, the system, including a bale of the fanfold material and the converting machine, may have a footprint size in the range of between about 24 square feet and about 48 square feet. The footprint size of the system may be increased by adding additional bales of fanfold material, which may be fed into the converting assembly to create packaging templates of various sizes.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The embodiments described herein generally relate to systems, methods, and devices for processing paperboard and similar fanfold materials and converting the same into packaging templates. More specifically, the described embodiments related to a compact, elevated converting machine with a direction changing outfeed guide and methods for converting fanfold materials into packaging templates.

While the present disclosure will be described in detail with reference to specific configurations, the descriptions are illustrative and are not to be construed as limiting the scope of the present invention. Various modifications can be made to the illustrated configurations without departing from the spirit and scope of the invention as defined by the claims. For better understanding, like components have been designated by like reference numbers throughout the various accompanying figures.

As used herein, the term "bale" shall refer to a stock of sheet material that is generally rigid and may be used to make a packaging template. For example, the bale may be formed of continuous sheet of material or a sheet of material of any specific length, such as corrugated cardboard and paperboard sheet materials. Additionally, the bale may have stock material that is substantially flat, folded, or wound onto a bobbin.

As used herein, the term "packaging template" shall refer to a substantially flat stock of material that can be folded into a box-like shape. A packaging template may have notches, cutouts, divides, and/or creases that would allow the packaging template to be bent and/or folded into a box. Additionally, a packaging template may be made of any suitable material, generally known to those skilled in the art. For example, cardboard or corrugated paperboard may be used as the template material. A suitable material also may have any thickness and weight that would permit it to be bent and/or folded into a box-like shape.

As used herein, the term "crease" shall refer to a line along which the template may be folded. For example, a crease may be an indentation in the template material, which may aid in folding portions of the template separated by the crease, with respect to one another. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape created by removing material from the template or by separating portions of the template, such that a cut through the template is created.

As used herein, the term "support surface" shall refer to a surface that supports the machine described herein. Examples of support surfaces include but are not limited to a floor, ground, foundation, or stand.

Figure 1:
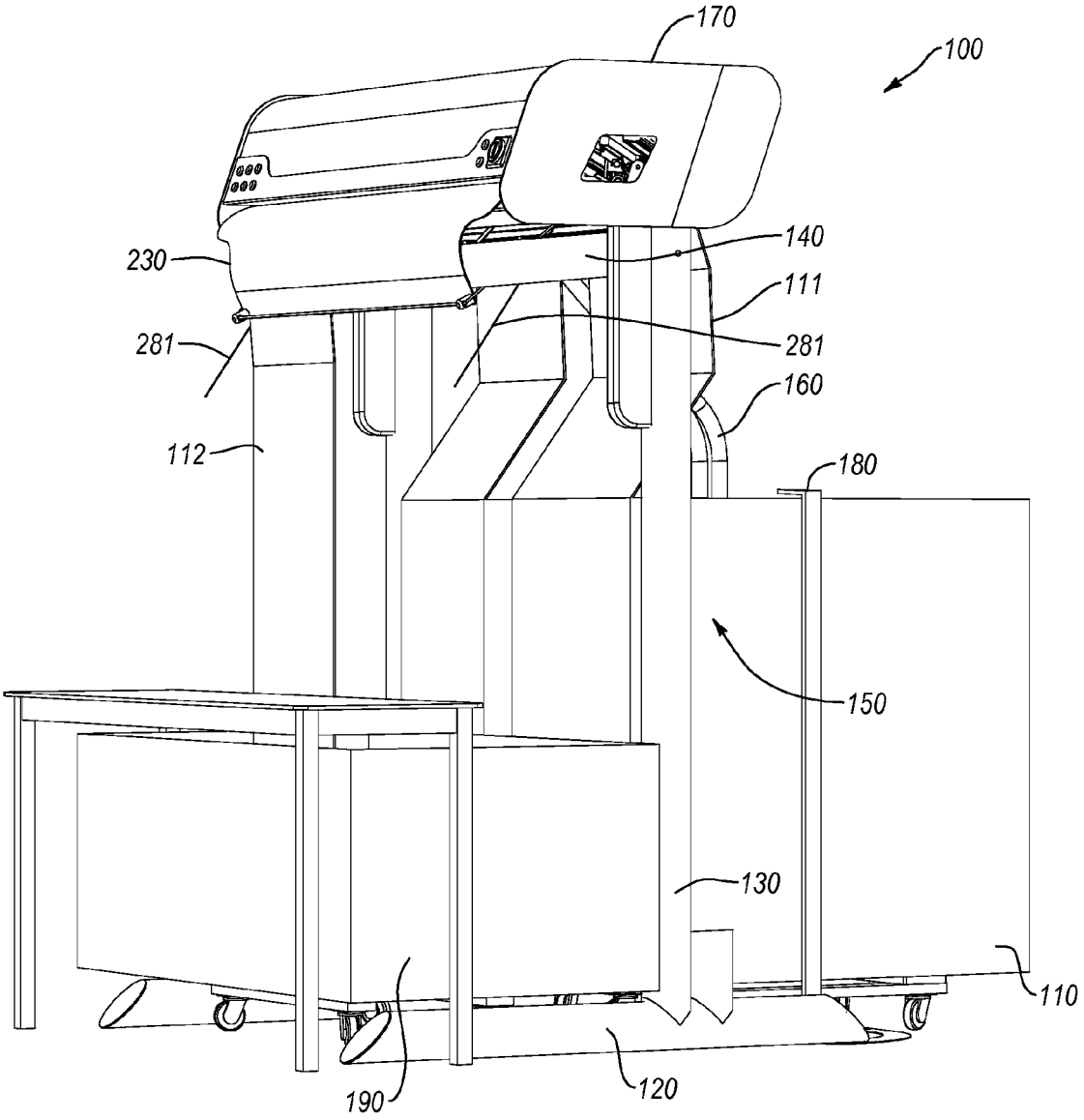
FIG. 1 illustrates a perspective view of an elevated converting machine and bales of fanfold materials, which are being fed through the converting machine, as described in one aspect of this disclosure.
Figure 2:
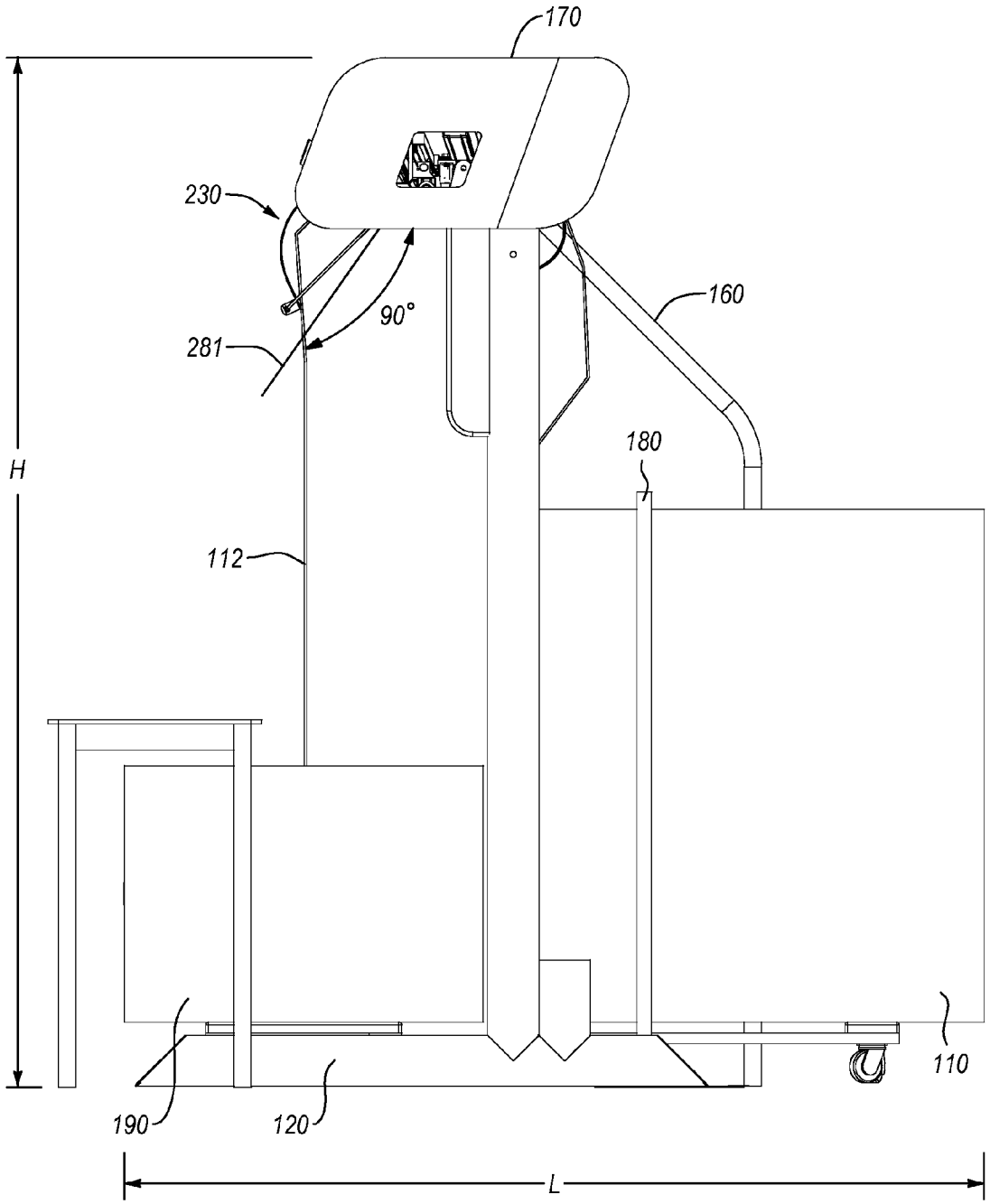
FIG. 2 illustrates a side view of the elevated converting machine and fanfold bales of FIG. 1.

As illustrated in the exemplary embodiment in FIGS. 1 and 2, an elevated converting machine 100 may comprise a converting assembly 170 mounted on a frame 150. The converting machine 100 may be configured to perform one or more conversion functions on a fanfold material 111, as described in further detail below. For example, the converting assembly 170 may receive fanfold material 111 from a fanfold bale 110 and convert the fanfold material 111 into packaging templates 112. The present disclosure describes the elevated converting machine 100 that may be substantially more compact than previously existing machines.

In some embodiments, the elevated converting machine 100 may include the frame 150 that has one or more supports 130 and a base 120. In at least one implementation, the one or more supports 130 may comprise two opposing supports 130. The supports 130 may be generally perpendicular to the base 120 and may be secured thereto. The base 120 and/or supports 130 may have generally tubular shapes. For example, the base 120 and supports 130 can be made from tubular steel, such as steel pipes. The supports 130 may have a substantially straight, bent, or arcuate shape. Furthermore, the supports 130 may be disposed at a substantially right, acute, or obtuse angle with respect to the base 120. There are numerous known methods for connecting the base 120 and supports 130; for example, supports 130 may be welded to the base 120. The base 120 may be positioned on a support surface. In some embodiments, the base 120 may be incorporated into the support surface. In some instances, the supports 130 may be fixed within or otherwise secured to the support surface. For example, the supports 130 may be secured within a concrete floor.

In some implementations, the frame 150 may include a crossbar 140, which may connect the upper ends of the supports 130 one to another and may be secured thereto in a similar manner as described above. Hence, in some implementations, the base 120, supports 130, and/or the crossbar 140 may constitute the frame 150. The crossbar 140 may provide additional rigidity as well as strength to the frame 150.

The converting assembly 170 may be selectively mounted on the frame 150 and may be elevated above the support surface. For example, the converting assembly 170 may be elevated above the top of the fanfold bale 110. Additionally or alternatively, the converting assembly 170 may be elevated to a height that would allow a packaging template 112 to hang therefrom without hitting the support surface below. In some embodiments, the converting assembly 170 may be mounted on the frame 150 and may be at least or about five feet above the support surface. In other embodiments, the converting assembly 170 may be mounted at a height such that it may be accessible by an operator without the aid of a step-stool or a ladder.

Furthermore, some implementations may include a converting assembly 170 that is mounted on the frame 150 such as to be at the height equal to or greater than the height of the operator. In some implementations, the machine 100 may a total height H in the range of 68 inches to 120 inches. Other implementations of the machine 100 may have a height H that is greater than 120 inches or less than 68 inches.

In some embodiments, the frame 150 may have one or more guide posts 160. The guide posts 160 may be disposed on the bale side of the elevated converting machine 100 and may provide additional support and/or stability thereto. The guide posts 160 may be substantially straight, bent, or arcuate, and may be made of tubular steel or other suitable material. In some implementations, the guide posts 160 may be secured to the base 120 and/or to the crossbar 140. Additionally or alternatively, the guide posts 160 may be secured to the converting assembly 170. Moreover, in some embodiments, the guide posts 160 may be movably or slidably connected with the frame 150, such that one or more of the guide posts 160 may be moved to increase or decrease the distance between the particular guide post 160 and the particular support 130. The movability of the guide posts 160 may accommodate fanfold bales 110 of different widths.

One or more fanfold bales 110 may be disposed proximate to the bale side of the elevated converting machine 100, and the fanfold material 111 may be fed into the converting assembly 170. The fanfold material 111 may be arranged in the bale 110 as multiple stacked layers. The layers of the fanfold material 111 may have generally equal lengths and widths and may be folded one on top of the other in alternating directions.

In the illustrated embodiment, each of the fanfold bales 110 is disposed proximate to and at least partially between a support 130 and a guide post 160. Additionally, the supports 130 and/or the guide posts 160 may function as guides that guide the fanfold bales 110 proximate to and into alignment with the elevated converting machine 100. Hence, the supports 130 and/or the guide posts 160 may also guide and/or align the fanfold material 111 with the converting assembly 170.

In some implementations, the bale may be positioned on a movable platform with rotatable casters. The bale 110 may be advanced toward the elevated converting machine 100 at an angle, such that a front edge of the bale 110 is not parallel with the converting assembly 170. If the bale 110 is not lined up with the converting assembly 170, as it is moved toward the converting assembly 170, the bale 110 will encounter and make contact with the support 130 and/or guide post 160. Subsequently, the bale 110 will be forced to rotate and align with the support 130, guide post 160, and, therefore, to align with the converting assembly 170. For example, the bale may be aligned with the converting assembly 170 such that the fanfold material 111 may be substantially aligned with an infeed guide 220 and fed through the converting machine 170 in a first direction and without getting jammed.

The clearance between the guide post 160 and support 130 may be such that the bale 110 may be aligned with the converting assembly 170. Generally, the clearance may vary depending on a width of the bale. For example, for a bale 110 of 24-inch wide fanfold material 111, the clearance may be approximately ½ inch—that is, the distance between the guide post 160 and the support 130 may be 24.5 inches. For bales of larger widths, the clearance between the guide post 160 and the support 130 may be greater. Conversely, for bales of smaller widths, the clearance between the guide post 160 and the support 130 may be smaller. In any case, the clearance between the guide post 160 and the support 130 may be small enough to straighten a skewed bale 110 (e.g., a bale 110 with layers that are not closely vertically aligned). In other words, as a skewed bale 110 is positioned between the guide post 160 and the support 130, the close clearance between the guide post 160 and the support 130 may cause the sides of the bale 110 to contact the guide post 160 and the support 130, thereby forcing the layers of the bale 110 into closer vertical alignment with one another and with converting assembly 170.

Figure 3:
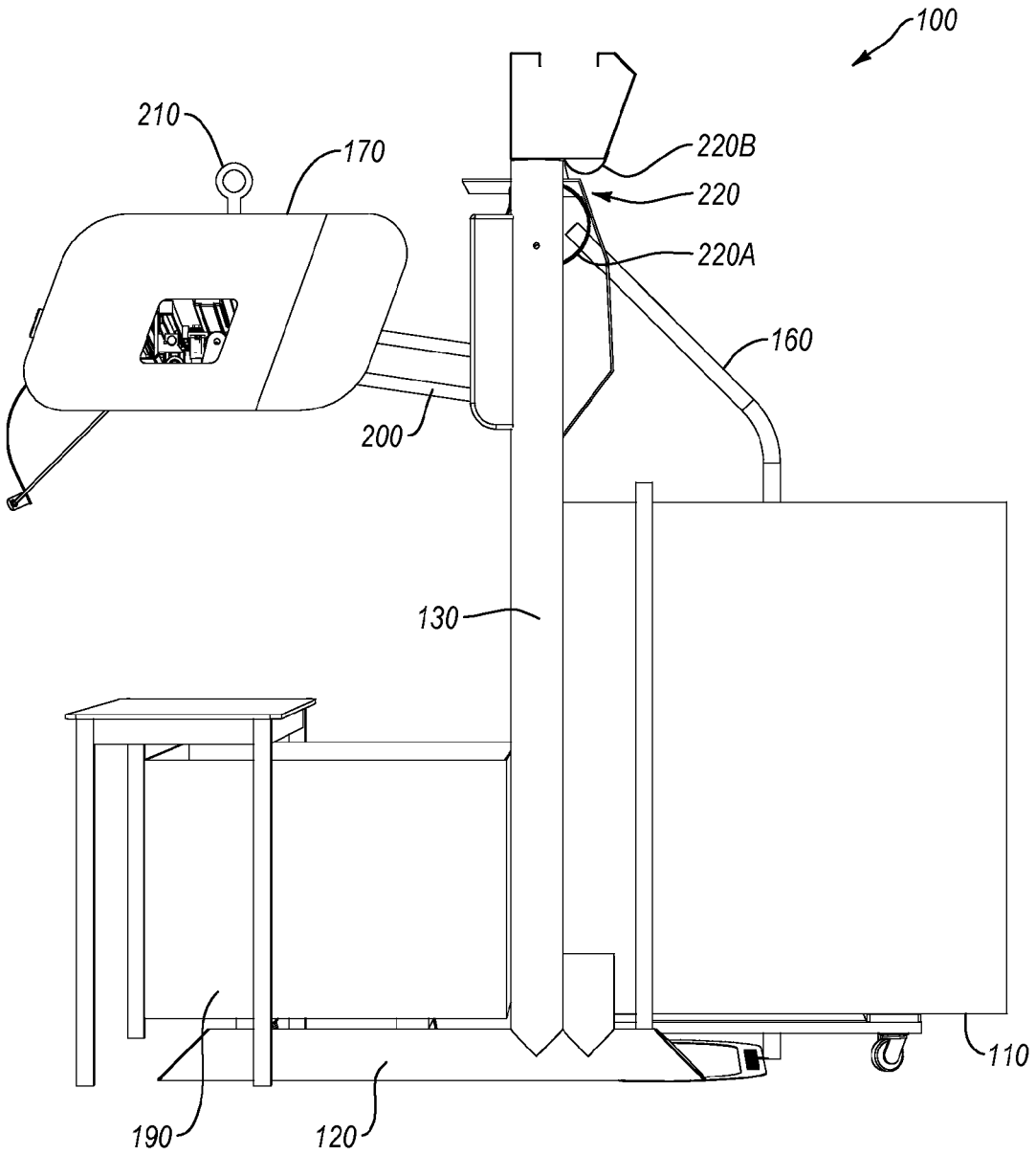
FIG. 3 illustrates a side view of the elevated converting machine of FIG. 1, with a converting assembly in a lowered or servicing position.

As illustrated in FIG. 3, the converting assembly 170 may be secured to the frame 150 or crossbar 140 with one or more hinges, such as with one or more parallel hinges 200. The hinges 200 may permit a user to selectively lower the converting assembly 170 from its uppermost or operating position, as shown in FIGS. 1 and 2, to a lower or servicing position as shown in FIG. 3. Allowing the converting assembly 170 to pivot or to be lowered to the illustrated servicing position may facilitate maintenance and repair of the converting assembly 170.

Figure 4:
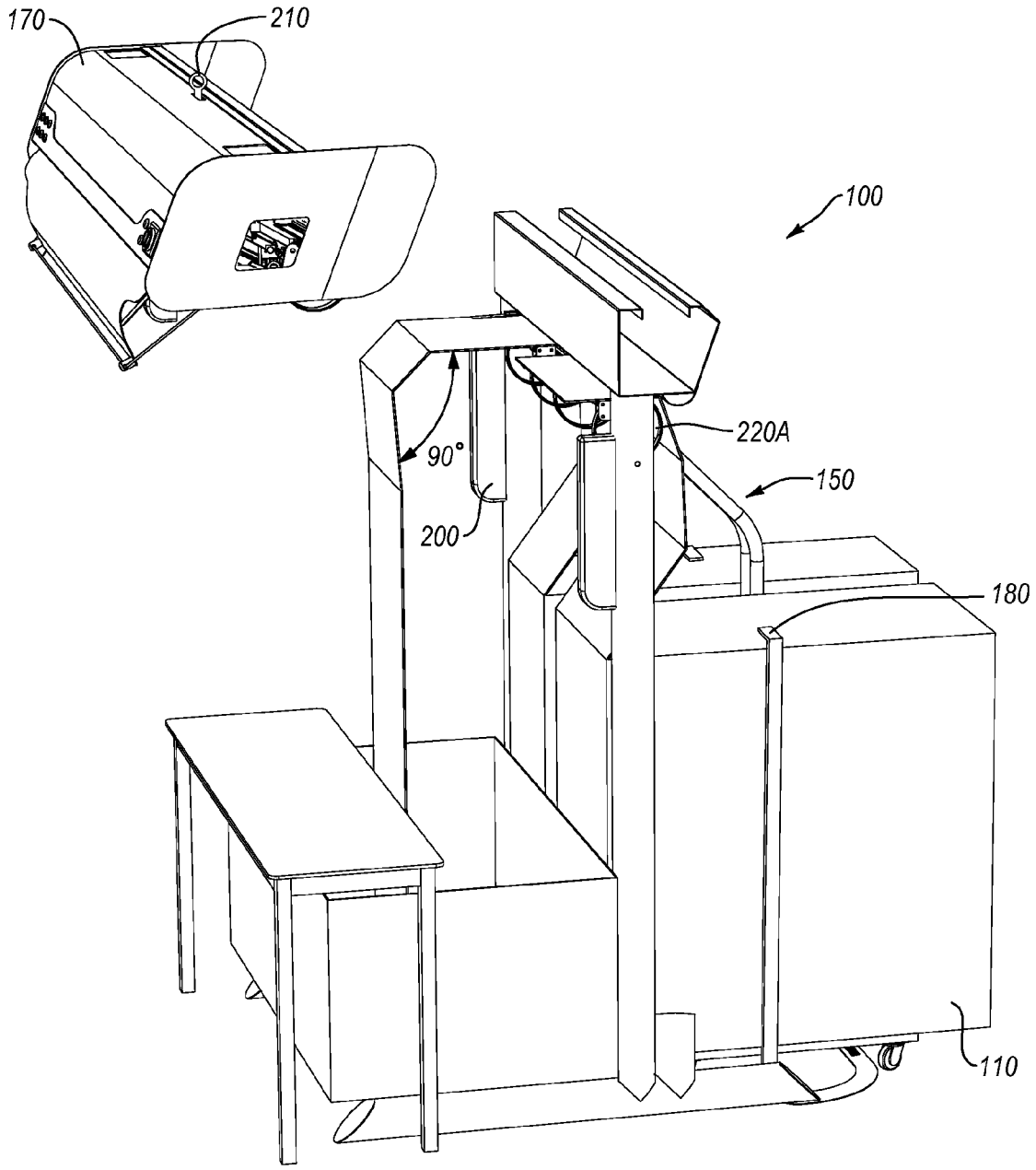
FIG. 4 illustrates a perspective view of the elevated converting machine of FIG. 1, with the converting assembly removed from the frame.

Additionally or alternatively, as illustrated in FIG. 4, the converting assembly 170 may be selectively removable from the hinges 200 and/or frame 150. As shown in FIGS. 3 and 4, some embodiments of the converting assembly 170 have a lift hook 210 that may facilitate removal of the converting assembly 170 from the frame 150 or from the hinges 200. The converting assembly 170 may be removed and/or replaced when a repair cannot be easily performed on location. There are numerous ways of selectively securing the converting assembly 170 to the hinges 200 and/or to the frame 150, which are known to those skilled in the art. For example, the converting assembly 170 may be secured with bolts, which may be unscrewed to detach and/or remove the converting assembly 170.

Figure 5A:
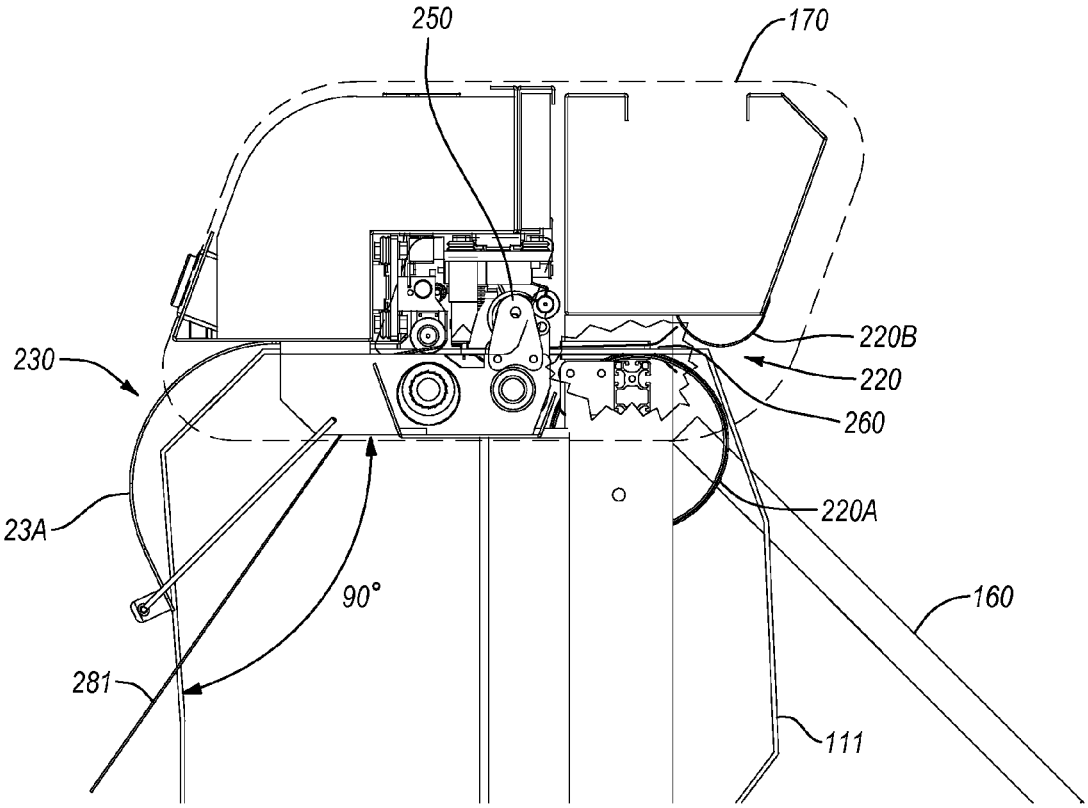
FIG. 5A illustrates a partial cross-sectional view of the elevated converting machine of FIG. 1, showing an infeed guide and feed rollers.
Figure 5B:
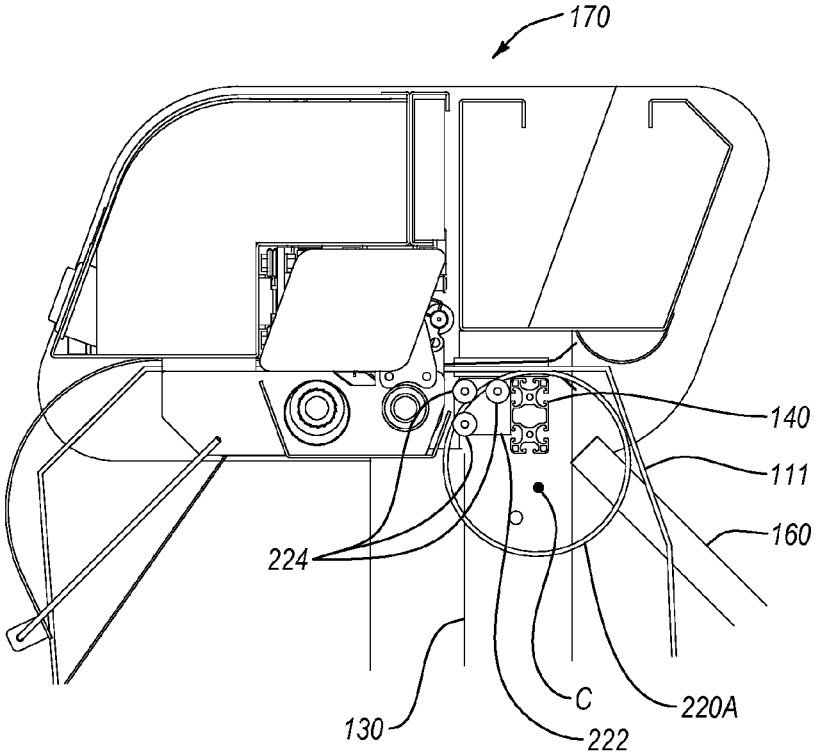
FIG. 5B illustrates a partial cut away view of the elevated converting machine of FIG. 1, showing infeed rings and wheel of the infeed guide.

As best seen in FIGS. 5A-5B, the elevated converting machine 100 also may have an infeed guide 220. The infeed guide 220 may be mounted on or secured to the frame 150. Additionally or alternatively, the infeed guide 220 may be secured to the converting assembly 170. The fanfold material 111 may be lifted from the bale 110 and fed through the infeed guide 220 into the converting assembly 170.

In some implementations, the infeed guide 220 may be positioned at a height that is higher than the top layer of the bale 110. The infeed guide 220 may also be positioned at a height that is lower than the combined height of the bale 110 plus the length of the bale 110. In other words, if the top layer of the bale 110 were rotated to extend vertically up from the bale 110, the infeed guide 220 would be at a height between the top and bottom of the vertically positioned layer of the bale 110.

In some implementations the height of the converting assembly 170 may be such that the fanfold material 111 will be force-folded (e.g., folded, creased, or bent) as it is pulled from the bale 110 and into the infeed guide 220. As shown in FIGS. 1-4, some embodiments include a bending member 180 that may intentionally create a crease or a bend in the fanfold material 111 as it is pulled away from the fanfold bale 110 and fed through the infeed guide 220. The intentional creasing or bending may facilitate a controlled bending of the fanfold material 111 as it is lifted off the bale 110 and pulled through the infeed guide 220, which may prevent unwanted or uneven bending or crumpling of the fanfold material 111 as it moves into the converting assembly 170. The bending member 180 may extend partially over the top of the bale 110 such that as a layer of fanfold material 111 is pulled up toward the infeed guide 220, the fanfold material 111 engages the bending member 180, thereby causing the fanfold material 111 to bend at the location of engagement. As the layer of fanfold material 111 continues moving up toward the infeed guide 220, the bending member 180 may bend or deflect out of the path of the layer of fanfold material 111. The bending member 180 may be constructed of any suitable material and may be sufficiently flexible to flex away from the fanfold material 111 after creating the crease. For example, a bending member may be made of spring steel or may be spring loaded.

As best seen in FIG. 5A, the infeed guide 220 may be comprised of a lower infeed guide section 220A and an upper infeed guide section 220B. The lower infeed guide section 220A and the upper infeed guide section 220B may each be solid, such as a curved plate or wheel, or may include separated aligned segments, such as multiple infeed rings, as illustrated in FIGS. 3, 5A, 5B, and 7. When formed by rings, the lower infeed guide section 220A (also referred to as infeed rings 22A) may rotate to facilitate smooth movement of the fanfold material 111 through the infeed guide 220. The lower infeed guide section 220A and the upper infeed guide section 220B may be formed of an elastic material, such as plastic or steel. For example, the guide sections may be formed of glass-filled nylon or spring steel.

As shown in FIG. 5B, infeed rings 220A are rotatably disposed around cross bar 140 so that infeed rings 220A may rotate as fanfold material 111 is fed into converting assembly 170. Each of infeed rings 220A is mounted in or extends through a wheel block 222. Each wheel block includes three wheels 224 that rotate within a generally vertical plane. As can be seen in FIG. 5B, the wheels 224 are generally arranged in the shape of a right triangle and the infeed ring 220A passes between the wheels 224 so that one of the wheels 224 is positioned on the outside of infeed ring 220A and two of the wheels 224 are positioned inside of infeed ring 220A. As infeed ring 220A rotates about cross bar 140, infeed ring 220A moves between wheels 224.

In the stationary position shown in FIG. 5B, the center C of infeed ring 220A is horizontally offset from wheels 224 toward fanfold material 111. As fanfold material 111 is fed into converting assembly 170, infeed rings 220A may rotate to facilitate the feeding of the fanfold material 111. As noted above, the infeed rings 220A may be formed of an elastic material so as to flex when pressure is applied thereto (e.g., such as when fanfold material 111 is pulled thereover). The offset between the center C of the infeed rings 220A and the wheels 224 allows for maximum flexing of infeed rings 220A as fanfold material 111 is pulled thereover. As infeed rings 220A flex, the center C thereof may move horizontally closer to wheels 224.

Figure 6:
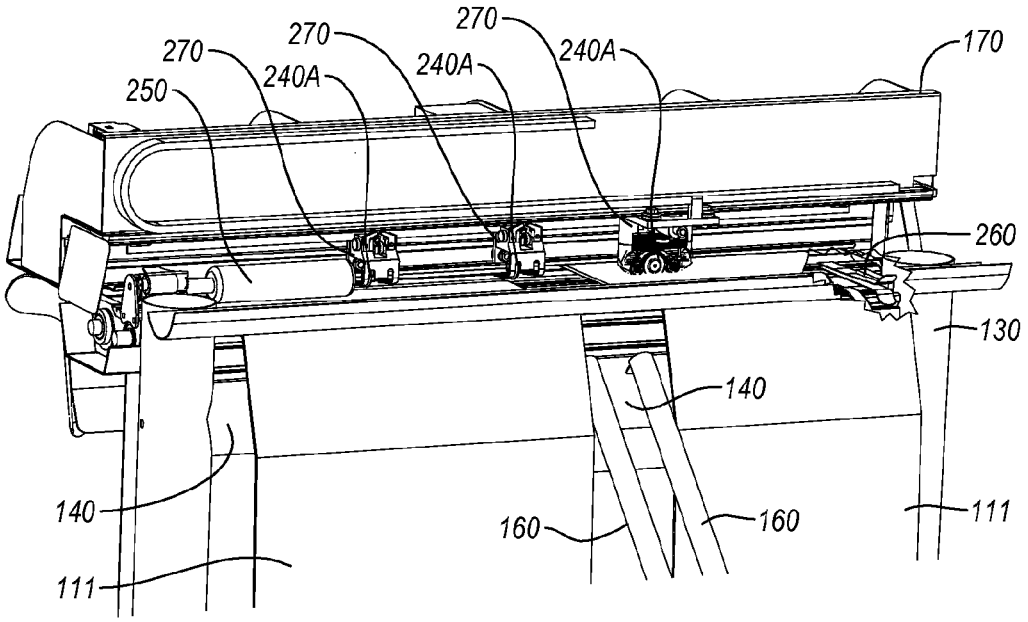
FIG. 6 illustrates a bale side perspective view of a portion of the elevated converting machine of FIG. 1 with a cover removed from the converting assembly to reveal a feed roller and converting tools.

As illustrated in FIGS. 5A-6, the elevated converting machine 100 may comprise one or more feed rollers 250. The one or more feed rollers 250 may pull the fanfold material 111 into the converting assembly 170 and advance the fanfold material 111 therethrough. The feed rollers 250 may be configured to pull the fanfold material 111 with limited or no slip and may be smooth, textured, dimpled, and/or teethed.

As also shown in FIGS. 5A and 6, the elevated converting machine 100 may further comprise one or more guide channels 260. The guide channels 260 may be configured to flatten the fanfold material 111, so as to feed a substantially flat sheet thereof into the converting assembly 170. In some implementations, the width of an opening in the guide channel(s) 260 may be substantially the same as the thickness (or gauge) of the fanfold material 111.

Figure 7:
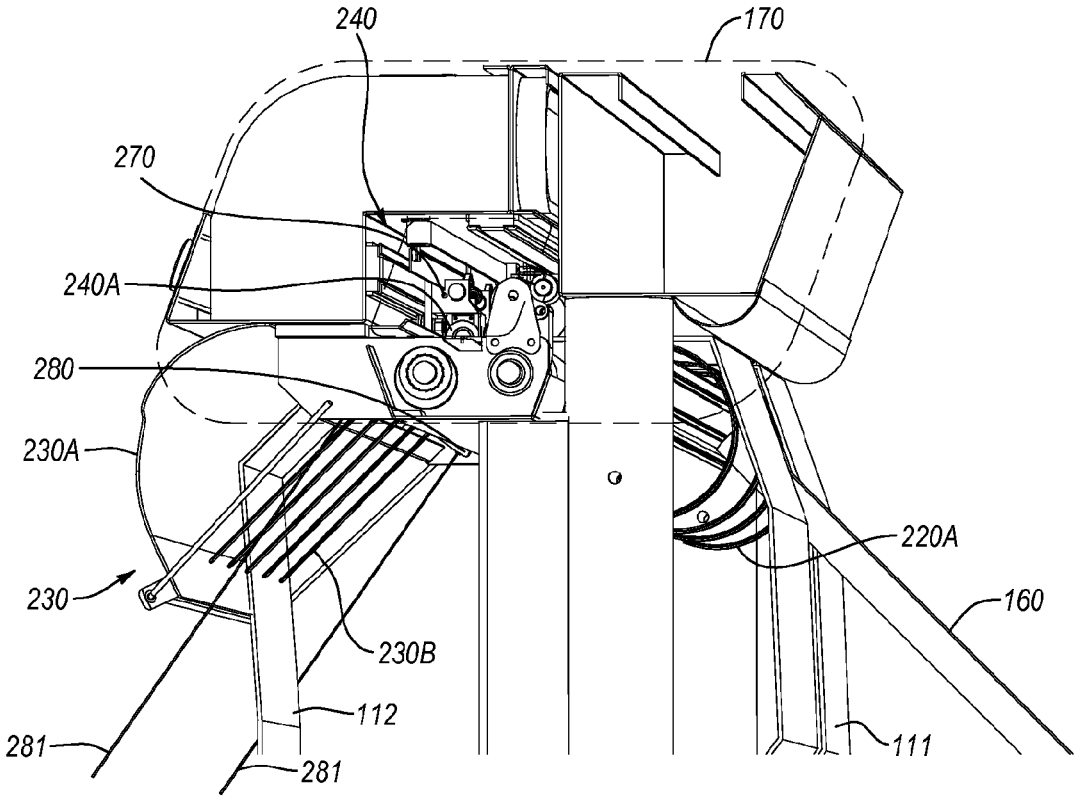
FIG. 7 illustrates a perspective view of a portion of the elevated converting machine of FIG. 1, with a side cover removed.

As shown in FIG. 7, the converting assembly 170 may comprise a conversion mechanism 240 that is configured to crease, bend, fold, perforate, cut, and/or score the fanfold material 111 in order to create packaging templates 112. The creases, bends, folds, perforations, cuts, and/or scores may be made on the fanfold material 111 in a direction substantially parallel to the direction of movement and/or length of the fanfold material 111. The creases, bends, folds, perforations, cuts, and/or scores may also be made on the fanfold material 111 in a direction substantially perpendicular to the direction of movement and/or length of the fanfold material 111.

The conversion mechanism 240 may include various tools 240A for making the creases, bends, folds, perforations, cuts, and/or scores in the fanfold material 111. U.S. Pat. No. 6,840,898, which is incorporated herein by reference in its entirety, describes exemplary converting mechanisms and converting tools that may be used in converting assembly 170.

Returning to FIG. 6, one or more of the tools 240A, such as cutting and creasing wheels, may move within the conversion mechanism 240 in a direction generally perpendicular to the direction in which the fanfold material 111 is fed through the conversion assembly 170 and/or the length of the fanfold material 111. For instance, one or more of the tools 240A may be disposed on a converting assembly cartridge 270. For example, the converting assembly cartridge 270 may have one or more longitudinal converting tools which may perform one or more conversion functions (described above) on the fanfold material 111 in a longitudinal direction (e.g., in the direction of the movement of the fanfold material 111 and/or parallel to the length of the fanfold material 111) as the fanfold material 111 advances through the converting assembly 170. The converting assembly cartridge 270 may move the one or more longitudinal converting tools back and forth in a direction that is perpendicular to the length of the fanfold material 111 in order to properly position the one or more longitudinal converting tools relative to the sides of the fanfold material 111. By way of example, if a longitudinal crease or cut needs to be made two inches from one edge of the fanfold material 111 (e.g., to trim excess material off of the edge of the fanfold material 111), the converting assembly cartridge 270 may move one of the longitudinal converting tools perpendicularly across the fanfold material 111 to properly position the longitudinal converting tool so as to be able to make the cut or crease at the desired location. In other words, the longitudinal converting tools may be moved transversely across the fanfold material 111 to position the longitudinal converting tools at the proper location to make the longitudinal conversions on the fanfold material 111.

The converting assembly cartridge 270 may also have one or more transverse converting tools, which may perform one or more conversion functions (described above) on the fanfold material 111 in a transverse direction (e.g., in the direction substantially perpendicular to the longitudinal direction). More specifically, the converting assembly cartridge 270 may move the one or more transverse converting tools 240A back and forth in a direction that is perpendicular to the length of the fanfold material 111 in order to create transverse (e.g., perpendicularly oriented) creases, bends, folds, perforations, cuts, and/or scores in the fanfold material 111. In other words, the transverse converting tools may be moved transversely across the fanfold material 111 in order to or while making the transverse conversions on the fanfold material 111.

According to some embodiments, the tools 240A may be selectively removable and/or replaceable. For instance, a worn or damaged tool 240A may be removed and replaced. Additionally, the tools 240A may be rearranged according to needs, such as when creating different templates 112. For instance, creasing wheels may be replaced with cutting wheels, scoring tools may be replaced with creasing wheels, etc. Moreover, in some implementations, the entire converting assembly cartridge 270 may be removable as a single unit, to be repaired or replaced with another suitable converting assembly cartridge 270.

As noted above, the converting assembly 170 may convert the fanfold material 111 into the packaging template 112. The packaging template 112 may be fed out of the conversion assembly 170 through an outfeed guide 230. The outfeed guide 230 may be configured to deflect and/or redirect the packaging template 112 from moving in one direction to another.

For example, the outfeed guide 230 may be configured to redirect the packaging template 112 from a first direction, which may be in a substantially horizontal plane, as shown in FIGS. 2 and 5A, to a second direction. The second direction may be generally perpendicular to the first direction. For example, the first direction may be substantially horizontal, while the second direction may be substantially vertical as shown in FIG. 2. The first direction and the second direction may also be considered to be generally perpendicular even when the first direction and the second direction form an acute or obtuse angle with respect to one another. By way of example, the second direction may form an angle with the first direction of between about 60° and about 120° while still being considered generally perpendicular. In one embodiment, the first direction and the second direction forms an angle of about 70°.

In some embodiments, the converting functions are performed on the fanfold material 111 when the fanfold material 111 is moving in the first direction. For instance, when the first direction is in a substantially horizontal plane, the fanfold material 111 may lie generally horizontally when the converting functions are being performed thereon. Thereafter, the resulting packaging template 112 may be reoriented or redirected to the second, generally vertical direction.

It is understood that the converting functions may be performed on the fanfold material 111 when the fanfold material 111 is in a non-horizontal plane or orientation. For instance, the converting functions may be performed on the fanfold material 111 when the fanfold material 111 is oriented at an angle relative to a support surface. Thereafter, the resulting packaging template 112 may be redirected to the second, generally vertical direction. Accordingly, the first direction and the second direction may form an angle with one another that is between about 0° and about 180°.

In some instances, one or more force-folds may be formed on the packaging template 112 as it is fed through the outfeed guide 230. For instance, as the packaging template 112 is advanced out of the converting assembly 170, the packaging template 112 may engage the outfeed guide in a manner that causes force-folding (e.g., the formation of one or more bends, creases, or folds) of the packaging template 112. The force-folds in the packaging template 112 may be caused by the shape of the outfeed guide 230 (e.g., the shape that causes the packaging template 112 to change directions), the relative positioning of the outfeed guide 230 to the location of the converting assembly 170 where the packaging template exits the converting assembly, or a combination thereof.

Additionally or alternatively, the outfeed guide 230 may be removably attached to the elevated converting machine 100, such as to facilitate removal and/or replacement of the outfeed guide 230. In some instances, a first outfeed guide 230 may be removed from the elevated converting machine 100 and replaced with a second outfeed guide 230. In some embodiments, the first outfeed guide 230 may be different in some respects from the second outfeed guide 230. For example, the second (replaced) outfeed guide 230 may have a larger radius than the first (removed) outfeed guide 230. Hence, with the second outfeed guide 230, the packaging templates 112 may be fed out at a predetermined maximum distance from the frame 150 that is greater than the predetermined maximum distance defined by the first outfeed guide 230.

In some implementations, the outfeed guide 230 also may be comprised of an outer outfeed guide section 230A and an inner outfeed guide section 230B. The packaging template 112 may be fed between the outer outfeed guide section 230A and the inner outfeed guide section 230B. The outfeed guide 230 may be configured to direct the packaging template 112 to a predetermined and predictable location. For example, the packaging template 112 can be fed out of the outfeed guide 230 at a predetermined distance from the frame 150, such that a user or a robotic arm can receive the packaging template 112 at substantially the same location every time.

In some implementations, the inner outfeed guide section 230B may be configured to support the packaging template 112 as it is being fed out of the converting assembly 170. The inner outfeed guide section 230B also may be configured to maintain the packaging template 112 at a predetermined minimum distance from the frame 150, as illustrated in FIG. 2.

The inner outfeed guide section 230B may have a substantially linear or arcuate shape. Additionally, in some implementations, the inner outfeed guide section 230B may be formed from guide rods. In other implementations, however, the inner guide section 230B may have other configurations, such as a flat or curved plate. In any case, the outfeed guide 230 may act as a safety cover. More specifically, the outer outfeed guide section 230A, the inner outfeed guide section 230B, and one or more side covers (not shown) may prevent a person from reaching a hand or other object into conversion assembly 170 and being injured or damaged by conversion mechanism 240.

As noted above, the outer outfeed guide section 230A may be configured to deflect and/or redirect the packaging template 112 from moving in one direction to another. The outer outfeed guide section 230A may also be configured to maintain the packaging template 112 at a predetermined maximum distance from the frame 150. In some implementations, the outer outfeed guide section 230A may have a generally arcuate shape, as illustrated in the exemplary embodiment of FIGS. 2, 3, 5A, 5B, and 7. In the illustrated embodiment, the outer outfeed guide section 230A is secured to the converting assembly 170. In other embodiments, however, the outer outfeed guide section 230A also may be secured to the frame 150.

After performing the conversion functions on the fanfold material 111, the converting assembly 170 may hold onto an end of the template 112 so that the template 112 hangs from the converting assembly 170, as shown in FIGS. 1 and 2. For instance, after the converting functions have been performed, the one or more feed rollers 250 may stop advancing the template 112 through the converting assembly 170 and may apply sufficient pressure to the template 112, so that the template 112 hangs from the converting assembly 112 until an operator removes the template 112. Any waste material produced during the conversion process may be collected in a collection bin 190.

As illustrated in FIG. 7, in some implementations the elevated converting machine 100 may have one or more sensors 280. Examples of suitable sensors include but are not limited to passive infrared sensors, ultrasonic sensors, microwave sensors, and tomographic detectors. After a specified event, such as detection of a user's hand or a robotic arm by the sensor 280, the elevated converting machine 100 may feed the remainder of the packaging template 112 out of the converting assembly 170. In other words, the converting assembly 170 may perform the conversion functions on the fanfold material 111 as the fanfold material is advanced through the converting assembly 170. After performing the conversion functions, the converting assembly may hold onto the resulting template 112, so that the template 112 hangs in a predictable position until a user reaches for the template 112. When sensor 280 detects the user's approaching hand, converting assembly 170 may release and/or advance the remainder of the template 112 out of converting assembly 170. As illustrated in FIGS. 1, 2, 5A, and 7, the sensors 280 may emit a beam 281 that detects the user's hand, and thereby causes the converting assembly 170 to release and/or advance the remainder of the template 112 out of the converting assembly 170.

Figure 8:
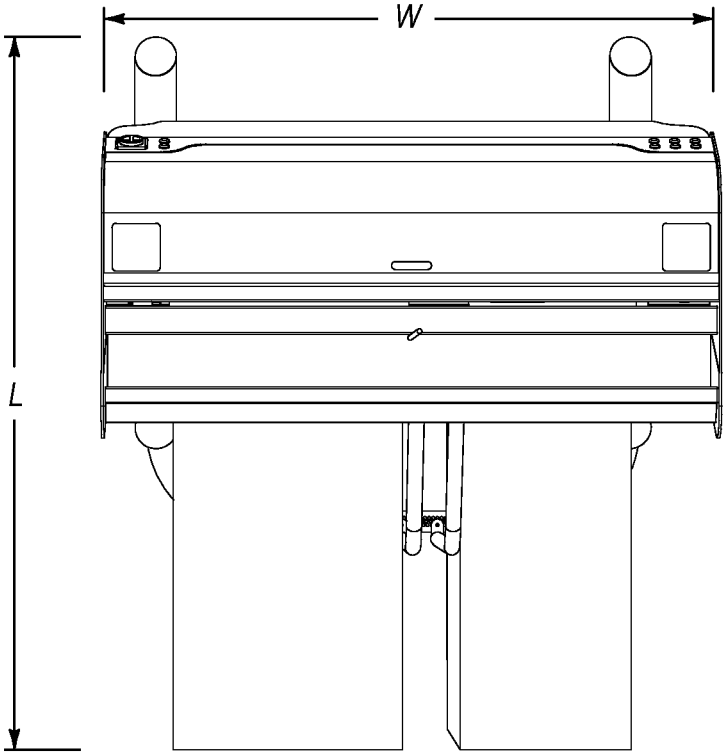
FIG. 8 illustrates a top view of the elevated converting machine and fanfold bales of FIG. 1.

As illustrated in FIGS. 2 and 8, the footprint of the above described system may be defined by a length L and a width W, which may include the elevated converting machine 100, the bales 110, and the area required to feed out the packaging templates 112. In some implementations, the footprint L×W may be in the range of between about 24 square feet and about 48 square feet.

In other implementations, however, the footprint may be larger than 48 square feet. In the illustrated embodiment, two bales 110 are positioned side-by-side in a single row next to converting machine 100. In other embodiments, however, multiple rows of one or more bales may be positioned adjacent to converting 100. The bales of the various rows may have different sizes from one another, thereby allowing for the creation of different sized packaging templates with less wasted fanfold material. The converting assembly 170 and/or frame 150 may be equipped with a cassette changer that enables fanfold material from the bales in the multiple rows to be fed into converting assembly 170. In any case, adding additional rows of fanfold bales may increase the footprint size of the overall system. By way of example, each additional row of fanfold bales may increase the footprint of the system by about 15 square feet.

In one or more implementations, the footprint also may include all of the various system components described herein, such as the frame 150, the converting assembly 170, and the fanfold bales 110. In addition to the system components, the footprint also includes the space required to feed out the templates 112. Implementations of the above system may have a length L in the range of 68 inches to 90 inches. In implementations where additional rows of fanfold bales are added, the length L of the system may increase by about 4 or 5 feet for each additional row of fanfold bales. Additionally, implementations of the above system may have a width W in the range of 40 inches to 70 inches. It is understood, however, that the converting machine 100, and thus the entire system, may also have a wider configuration so as to accept wider fanfold bales and/or more fanfold bales in each row of bales.

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A converting machine used to convert generally rigid fanfold material into packaging templates for assembly into boxes or other packaging, the converting machine comprising:

an infeed that directs said fanfold material into said converting machine;

one or more feed rollers that move said fanfold material through said converting machine in a first direction from a first side of the converting machine to a second side of the converting machine opposite to the first side;

a converting assembly configured to perform one or more conversion functions on said fanfold material as said fanfold material moves through said converting machine, the one or more conversion functions being selected from the group consisting of creasing, bending, folding, perforating, cutting, and scoring, to create said packaging template, the converting assembly comprising:

one or more cutting wheels that create cuts in said fanfold material that are perpendicular to the first direction; and one or more creasing wheels that create longitudinal creases in said fanfold material, the longitudinal creases being parallel to the first direction, at least one of the one or more creasing wheels being adapted to be repositioned along a width of said fanfold material in order to make longitudinal creases at different positions along the width of said fanfold material;

an outfeed guide that changes the direction of movement of said fanfold material from the first direction to a second direction after the converting assembly has performed the one or more conversion functions on said fanfold material, the second direction being angled relative to the first direction such that a first end of said fanfold material is positioned closer to a support surface than a second send of said fanfold material when said fanfold material is moving in the second direction; and a frame that elevates the converting assembly above the support surface, the frame comprising a base and upright supports, wherein the frame spaces the converting assembly apart from the support surface while still allowing an operator to load said fanfold material into the infeed without the aid of a step-stool or ladder.

2. The converting machine of claim 1, wherein the converting assembly comprises one or more cutting wheels that create one or more longitudinal cuts in said fanfold material, wherein the longitudinal cuts are parallel to the first direction.

3. The converting machine of claim 2, wherein at least one of the one or more cutting wheels is adapted to be repositioned along a width of said fanfold material in order to make longitudinal cuts at different positions along the width of said fanfold material.

4. The converting machine of claim 1, wherein the outfeed guide comprises a first outfeed guide, wherein the first outfeed guide may be selectively removed from said converting machine and replaced with a second outfeed guide having a different size, angle, or shape than the first outfeed guide.

5. The converting machine of claim 1, further comprising one or more outfeed guide members that cooperate with the outfeed guide to position at least a portion of the packaging template in a predictable position after the converting assembly has performed the one or more conversion functions on said fanfold material, and further comprising a sensor that detects the approach of an operator's hand to remove the packaging template from said converting machine, wherein said converting machine advances the packaging template out of said converting machine and/or releases the packaging template upon detection of the approach of the operator's hand.

6. The converting machine of claim 1, wherein the infeed comprises one or more infeed rings that are adapted to rotate as said fanfold material enters said converting machine, wherein the one or more infeed rings are formed of an elastic material.

7. The converting machine of claim 6, wherein each of the one or more infeed rings passes through a wheel block having a plurality of wheels.

8. The converting machine of claim 7, wherein the plurality of wheels is horizontally offset from the center of the one or more infeed rings, thereby increasing the elastic response of the one or more infeed rings.

9. The converting machine of claim 1, wherein the infeed comprises a curved infeed guide plate, wherein the curved infeed guide plate is formed of an elastic material.

10. The converting machine of claim 1, wherein said fanfold material is arranged in a bale of multiple stacked layers, each layer having a substantially equal length defined between first and second ends of the bale, the multiple stacked layers having pre-existing fanfold crease lines at each end to separate the multiple layers and allow the fanfold material to stack on top of itself.

11. The converting machine of claim 10, wherein the infeed is positioned at a height greater than a height of a top layer of the bale of said fanfold material.

12. The converting machine of claim 10, wherein the infeed is positioned at a height that is less than a height of a top layer of the bale plus the length of a layer of the bale.

13. The converting machine of claim 12, wherein the height of the infeed relative to the top layer of the bale requires one or more of the layers of the bale to be force-folded to in order to be directed through the infeed and into the converting machine.

14. The converting machine of claim 13, further comprising a creasing tool that forms a crease or fold in the one or more layers of the bale to facilitate insertion of the fanfold material into the infeed.

15. The converting machine of claim 14, wherein the creasing tool comprises a flexible and resilient arm extending over a side of the bale.

16. The converting machine of claim 1, wherein the frame comprises one or more guide posts that facilitate proper positioning and alignment of one or more bales of said fanfold material relative to the converting machine.

17. The converting machine of claim 16, wherein the one or more guide posts extend between the converting assembly and the support surface, wherein the portions of the one or more guide posts positioned adjacent the support surface are offset from the base in a direction that is parallel to the first direction, thereby allowing an angled entry of a bale of said fanfold material under the frame.

18. The converting machine of claim 17, wherein the one or more guide posts align the bale with the conversion assembly, such that edges of the fanfold material may be substantially parallel with the first direction.

19. The converting machine of claim 16, wherein the one or more bales of fanfold material each comprise stacked layers of fanfold material, and wherein the one or more guide posts assist in straightening the one or more bales such that the stacked layers of fanfold material are positioned directly above one another.

20. A converting machine used to convert fanfold material into packaging templates for assembly into boxes or other packaging, the converting machine comprising:

a frame;

a converting assembly cartridge selectively mounted on the frame, the converting assembly cartridge comprising:

at least one longitudinal converting tool that performs one or more conversion functions on said fanfold material in a first, longitudinal direction;

at least one transverse converting tool that performs one or more conversion functions on said fanfold material in a second, transverse direction that is perpendicular to the first, longitudinal direction; and one or more feed rollers that move said fanfold material through said converting machine in the first, longitudinal direction, wherein the converting assembly cartridge, including the longitudinal and transverse converting tools and the one or more feed rollers, is selectively removable as a single unit from the frame; and an infeed guide mounted on the frame, wherein the infeed guide directs said fanfold material into said converting assembly cartridge.

21. The converting machine of claim 20, wherein the longitudinal and transverse converting tools are configured to perform one or more conversion functions on said fanfold material, the one or more conversion functions being selected from the group consisting of creasing, bending, folding, perforating, cutting, and scoring, to create said packaging template.

22. The converting machine of claim 20, further comprising an outfeed guide that changes the direction of movement of said fanfold material from the first, longitudinal direction to a second, vertical direction after the converting assembly cartridge has performed the conversion functions on said fanfold material.

23. The converting machine of claim 22, wherein the outfeed guide comprises a arcuate shaped surface that changes the direction of said fanfold material from the first, longitudinal direction to the second, vertical direction as said fanfold material moves against the arcuate shaped surface.

24. The converting machine of claim 22, wherein the first, longitudinal direction is within a horizontal plane and the outfeed guide changes the direction of movement of said fanfold material by about 90 degrees to the second, vertical direction.

25. The converting machine of claim 20, further comprising a set of interchangeable outfeed guides that may be selectively coupled to said converting assembly cartridge, wherein each outfeed guide of the set of outfeed guides changes the direction of movement of said fanfold material from the first, longitudinal direction to another direction after the converting assembly cartridge has performed the conversion functions on said fanfold material.

26. The converting machine of claim 25, wherein a first outfeed guide from the set of interchangeable outfeed guides changes the direction of movement of said fanfold material from the first, longitudinal direction to a second, vertical direction, and a second outfeed guide from the set of interchangeable outfeed guides changes the direction of movement of said fanfold material from the first, longitudinal direction to a second direction that forms a obtuse angle with the first, longitudinal direction.

27. The converting machine of claim 20, wherein the frame holds the converting assembly cartridge at a height of about five feet above a support surface upon which the frame rests.

28. The converting machine of claim 20, wherein the converting assembly cartridge is movably connected to the frame such that the converting assembly cartridge may be selectively moved between an operating position and a servicing position.

29. The converting machine of claim 28, wherein the converting assembly cartridge is movably connected to the frame with a parallel hinge assembly.

30. A system for forming packaging templates for assembly into boxes or other packaging, the system comprising:

a stack of fanfold material;

a converting machine used to convert the fanfold material into said packaging templates, the converting machine being positioned adjacent to the stack of fanfold material, the converting machine comprising:

a frame that rests upon a support surface;

a converting assembly mounted on the frame such that the converting assembly is positioned at a height above the support surface that is equal to or greater than a height of a user, the converting assembly comprising:

one or more feed rollers that move the fanfold material through the converting assembly in a first direction;

one or more converting tools configured to perform one or more conversion functions on the fanfold material as the fanfold material moves through the converting assembly in order to form said packaging templates, the one or more conversion functions being selected from the group consisting of creasing, bending, folding, perforating, cutting, and scoring; and an outfeed guide that changes the direction of movement of the fanfold material from the first direction to a second, vertical direction after the converting assembly has performed the one or more conversion functions on the fanfold material, wherein the outfeed guide contains said packaging templates within the footprint of the system regardless of the size of said packaging templates and until a user removes said packaging templates from the converting assembly, a waste container for collecting waste fanfold material;

wherein the system, including the stack of fanfold material and the converting machine, has a footprint size in the range of between about 24 square feet and about 48 square feet; and wherein the waste container is positioned at least partially below the converting assembly and fits within the system footprint size of between about 24 square feet and about 48 square feet.

31. The system of claim 30, wherein the outfeed guide is contained with the footprint of the system.

32. The system of claim 30, wherein the stack of fanfold material is in a first row of fanfold material stacks, the system further comprising one or more additional rows of fanfold material stacks positioned adjacent to the first row of fanfold material stacks, wherein each additional row of fanfold material stacks increases the footprint size of the system by about 15 square feet.

* * * * *